United States Patent [19]

Hein

[11] 4,260,279

[45] Apr. 7, 1981

[54] END SEAL FOR EXPANSION JOINT SEALING ASSEMBLY

[75] Inventor: Richard D. Hein, Wabash, Ind.

[73] Assignee: The General Tire & Rubber Company, Ohio

[21] Appl. No.: 18,960

[22] Filed: Mar. 9, 1979

[51] Int. Cl.[3] ..... E01C 11/02

[52] U.S. Cl. ..... 404/74; 404/69; 52/396

[58] Field of Search ..... 404/67, 68, 69, 64, 404/47; 52/396; 285/294, 297

[56] References Cited

U.S. PATENT DOCUMENTS

| | | | |
|---|---|---|---|
| Re. 26,733 | 12/1969 | Welch | 404/67 |
| 2,319,949 | 5/1943 | Robertson | 404/67 |
| 2,674,872 | 4/1954 | Grund | 404/67 X |
| 3,375,763 | 4/1968 | Welch | 404/67 |
| 3,690,226 | 9/1972 | Hein | 404/68 |
| 3,758,220 | 9/1973 | Hein | 404/67 |
| 3,814,530 | 6/1974 | Neff | 404/67 |
| 3,827,817 | 8/1974 | Czernik | 404/67 |
| 3,992,121 | 11/1976 | Geiger | 404/67 X |
| 4,053,176 | 10/1977 | Hilbush | 285/294 X |

*Primary Examiner*—Nile C. Byers, Jr.

[57] ABSTRACT

An improved sealing assembly for sealing the expansion gap between adjacent sections of a structure has elongated elastomeric pads laid end to end along the length of the gap with a groove in at least one of the end surfaces of each pad for containing a flowable sealant.

The groove has an inlet port at the top edge of the end surface through which the flowable sealant may be injected, an intermediate sealing portion for housing the sealant to prevent debris and liquid from passing between the end faces, and a vent portion communicating between the intermediate sealing portion and the top edge of the end surface, so that sealant emerging from the top of the vent portion will indicate that the intermediate sealing portion has been filled.

8 Claims, 9 Drawing Figures

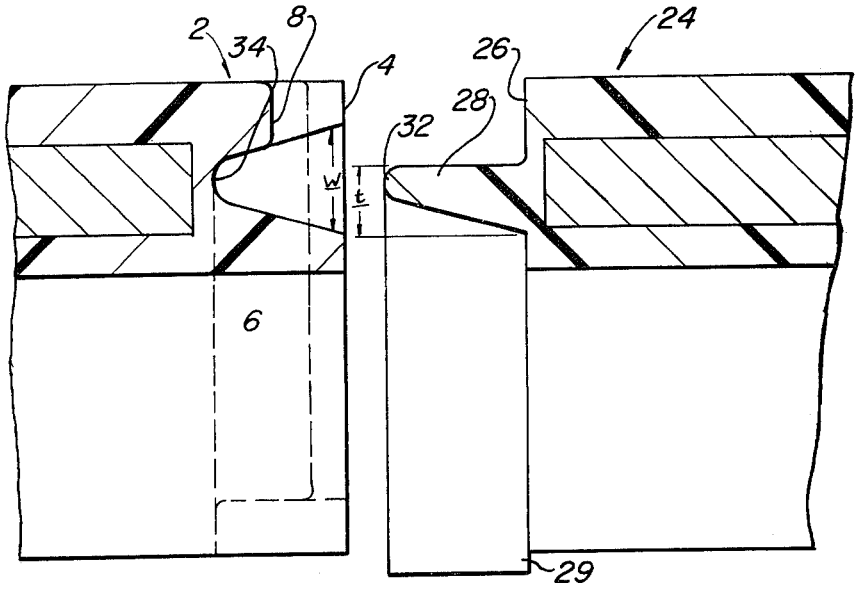
FIG. 5
FIG. 6
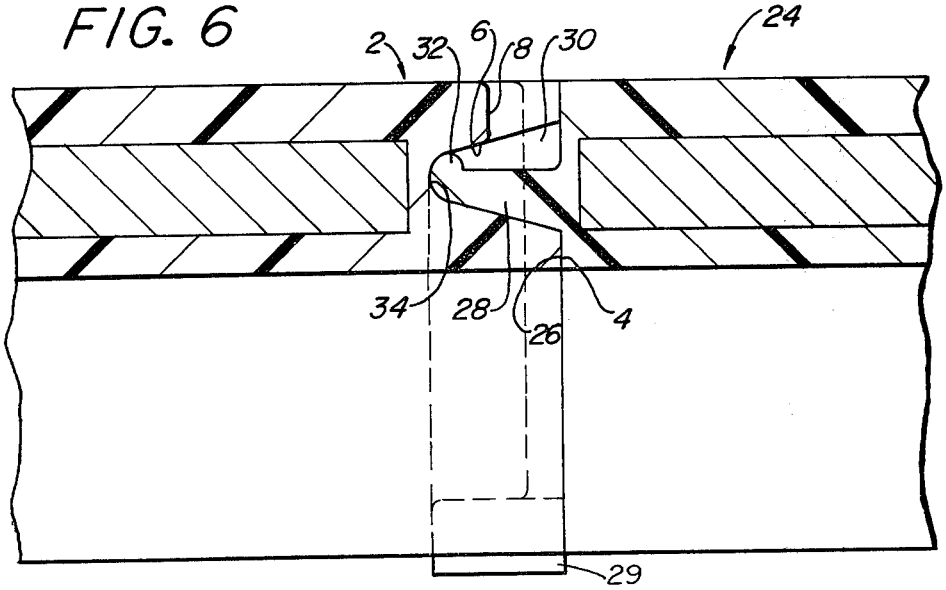

END SEAL FOR EXPANSION JOINT SEALING ASSEMBLY

This invention relates in general to elastomeric sealing assemblies for sealing the expansion gap between adjacent sections of a structure. More particularly, the invention relates to an improvement in the construction of the abutting end surfaces of such sealing assemblies.

Elastomeric sealing assemblies used in the expansion joints of bridges, parking decks, and like structures are made in elongated sections, typically one to two meters in length, and installed in end-to-end relationship along the length of each joint. An example of such joint sealing assemblies are shown in U.S. Pat. No. 3,375,763, the corresponding U.S. Pat. No. Re. 26,733, and U.S. Pat. No. 3,690,226, all assigned to the assignee of the present invention. The primary function of these sealing assemblies is to prevent debris and liquid from passing into the expansion gap between the adjacent structure sections. Of course, this means that the cracks or spaces between the end surfaces of the individual sections of the sealing assemblies must themselves be sealed against the passage of debris and liquid.

One method and means of sealing such end surfaces has been to coat the end surfaces with an adhesive sealant prior to installation, and then lay the assembly sections end to end in the joint and press them together in the lengthwise direction. Then, the assembly sections are bolted down, while at the same time attempting to keep them pressed together lengthwise. The main problem with this sealing method is that it is difficult to bolt down the assembly sections while maintaining the necessary lengthwise pressure on the sections to keep them from separating after installation. This difficulty may be reduced by forming the end surfaces of the assemblies with tongue and groove locking structures, such as shown in FIGS. 3 and 4 of U.S. Pat. No. 3,690,226. However, such tongues and grooves must still be coated with adhesive sealant prior to installation, and thus some lengthwise pressure is still required to insure that the parts are sealed and that no dirt or liquid can pass around the tongue and groove.

With sealing assembly constructions shown in U.S. Pat. Nos. 3,827,817 and 3,992,121, the end surfaces of the assembly sections are tapered with respect to each other so that they present a channel between them that is open at the top. At their bottom edges, the tapered end surfaces come together to form a V-shaped channel, and a flange on the bottom of one of the assembly sections fits under and is bonded to the other assembly section to prevent the sections from pulling apart. One problem with such a construction is that the sealant must still be applied prior to installation of the assembly sections, because after such installation, the sealant cannot be injected from above the channel between the sections with the right force and direction to fill the bottom of the channel or to coat the bottom sealing flange on the one assembly section. Another problem is that this construction is designed for joining the end surfaces of pads that are completely supported on the structure surfaces adjacent the gap. If an open channel closed at the bottom by an overlapping flange were employed across the expansion gap, the bottom flange might buckle or hang down at that location, allowing sealant to flow out of the channel at the location where it is most needed to prevent seepage of debris and liquid into the expansion gap.

The present invention provides an expansion joint sealing assembly for sealing the gap between two sections of a structure wherein the individual elongated pads that make up the assembly have their end surfaces formed so they can easily be joined together and a sealant applied between these surfaces after installation of the pads to provide a reliable, long lasting, effective seal across an expansion gap against the flow of debris and liquids. This is accomplished by providing in at least one of each pair of facing end surfaces of adjacent pads a groove that has a sealant receiving inlet port at the top edge of the end surface, an intermediate sealing portion extending from the inlet port toward the bottom edge of the end surface, and a vent portion that communicates with the intermediate sealing portion and also with the top edge of the end surface at a location spaced laterally from the inlet port.

Preferably, the end surface of the adjacent pad facing the end surface with the aforementioned groove also has means aligned with at least a part of the intermediate sealing portion of that groove to aid the sealant in the groove in forming a secure bond to both of said end surfaces. This means may take the form of a tongue projecting from the end surface of the adjacent pad that is of a thickness less than the width of the groove, but projects from its associated end surface a distance greater than the depth of the aforementioned groove, so that when the pads are placed end to end with respect to each other, the groove both houses the tongue and provides a channel for the sealant and the outward tip of the tongue is compressed against the base of the groove. Alternatively, the aforementioned means can be another groove aligned with and facing the first mentioned groove.

A preferred feature of each of the aforementioned end surface constructions is that each of the mentioned grooves have intermediate sealing portions communicating over a part of its length with the bottom edge of its end surface at a location where the bottom edge is designed to rest on one of the aforementioned structure sections.

The foregoing objects, features, and embodiments of the present invention, as well as others, will be more apparent from the following description of the invention, and the attached drawings, in which:

FIG. 5 is a sectional view of both of the end portions of the elastomeric pads of FIGS. 1 through 4, taken along line V—V of FIG. 1 and line V—V of FIG. 3, and showing the two pad end portions aligned with each other prior to being joined together;

FIG. 6 is a sectional view along lines V—V of FIGS. 1 and 3 of the elastomeric pad end portions of FIG. 5 after they have been joined together;

Figure 1:
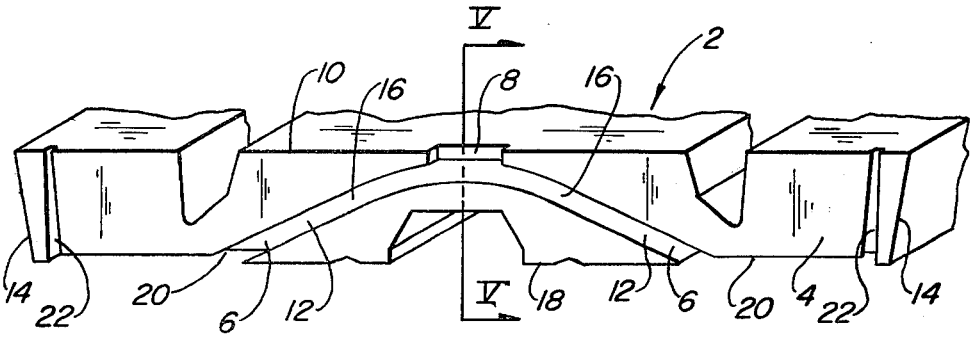
FIG. 1 is a perspective view of the end portion of an elastomeric pad of an expansion joint sealing assembly illustrating one embodiment of the present invention.
Figure 2:
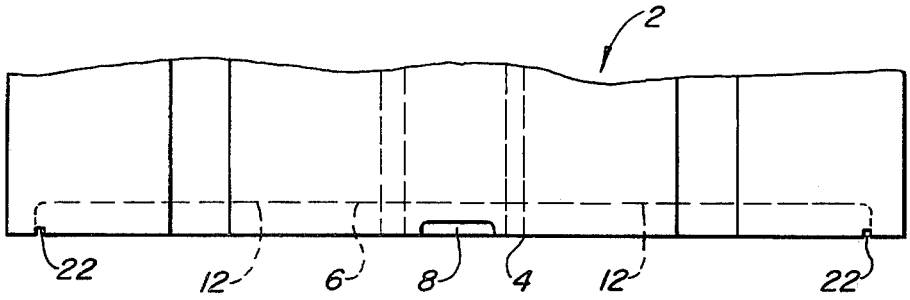
FIG. 2 is a top view of the end portion of the elastomeric pad of FIG. 1.

Referring to FIGS. 1 and 2, an elastomeric pad 2 is of the same basic construction as the expansion joint seal shown in U.S. Pat. No. 3,375,763, reissued as U.S. Pat. No. Re. 26,733. However the pad 2 has an improved surface 4 that enables a better sealing engagement with the end surface of an adjacent elastomeric pad.

Specifically, there are two grooves 6 in the end surface 4. The grooves 6 meet at a common inlet port 8 in the center of the top edge 10 of the end surface 4. Communicating with the inlet port 8 are intermediate sealing portions 12 of the grooves 6, that extend in opposite directions toward the side edges 14 of the end surface 4. Each intermediate sealing portion 12 has a part 16 that curves downwardly toward the bottom edge 18 of the end surface 4. Preferably, the part 16 extends all the way to the bottom edge 18, where it merges into another part 20 of the intermediate sealing portion 12 that extends along the bottom edge 18. The groove part 20 is at a location where the bottom edge 18 is designed to rest on one of the two structure sections that are separated by an expansion gap. Near the side edges 14, vent portions 22 extend from the parts 20 of intermediate sealing portions 12 up to the top edge 10 of the end surface 4.

Figure 3:
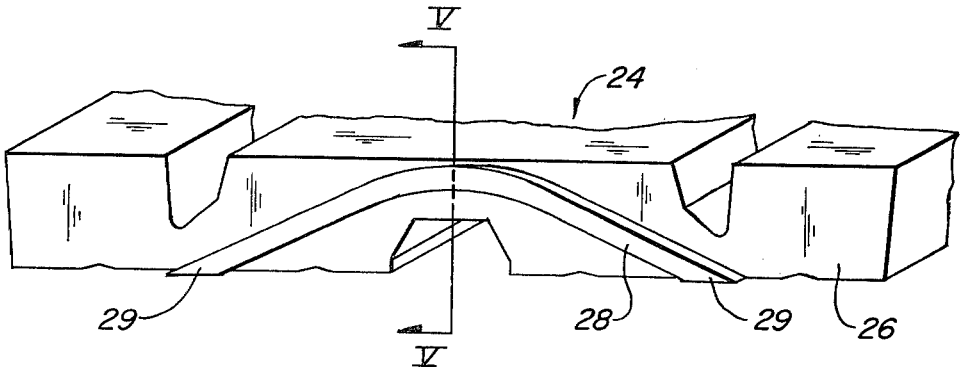
FIG. 3 is a perspective view of one form of an end portion of an elastomeric pad designed to mate with the end portion of the elastomeric pad shown in FIG. 1.
Figure 4:
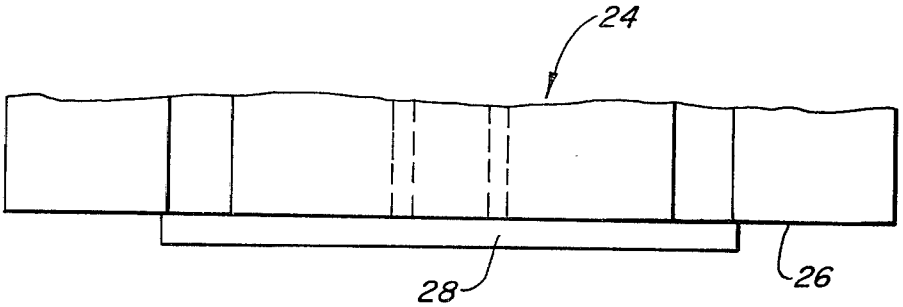
FIG. 4 is a top view of the end portion of the elastomeric pad of FIG. 3.

In FIGS. 3 and 4 is shown an elastomeric pad 24 with an end surface 26 that is designed to be joined to the end surface 4 of the pad 2 of FIGS. 1 and 2. The end surface 26 has a projecting tongue 28 aligned with the part 16 of the intermediate sealing portion 12 of groove 6 in the end surface 4, when the pads 2 and 24 are placed end to end over an expansion gap.

The details of the tongue 28 and its mating with the groove 6 are shown in the sectional views of FIGS. 5 and 6. As these figures show, the lower ends 29 of the tongue 28 preferably extend below the bottom of the pad 24, by about 1.6 mm., so that these ends 29 are compressed against a structure surface on which the pad 24 is placed. This helps prevent liquid and debris from passing around the ends of the tongue 28. Also, it should be noted that the tongue 28 has a thickness t less than the width w of the groove 6 (FIG. 5), so that when the tongue 28 is placed inside the groove 6, as shown in FIG. 6, a channel 30 is still provided by the groove 6 for housing a sealant. In addition, the tongue 28 projects from the end surface 26 a distance greater than the depth of the groove 6, so that when the tongue 28 is placed inside the groove 6 with the surfaces 4 and 26 flush against each other (FIG. 6), the outward tip 32 of the tongue 28 will be compressed against the base 34 of groove 6. Thus compressed, the tongue 28 will prevent most debris and liquid from seeping past it and into an expansion gap beneath. For added protection however, the chamber 30 is filled with sealant which becomes bonded to the enclosing surfaces of groove 6, tongue 28, and end surface 26.

During installation of the elastomeric pads 2 and 24 over an expansion gap, the fitting of the tongue 28 into the groove 6 helps align the pads properly with respect to each other. In addition, the compression of the tip 32 of the tongue 28 against the base 34 of groove 6 help contain the sealant when it is injected into the channel 30.

Figure 7:
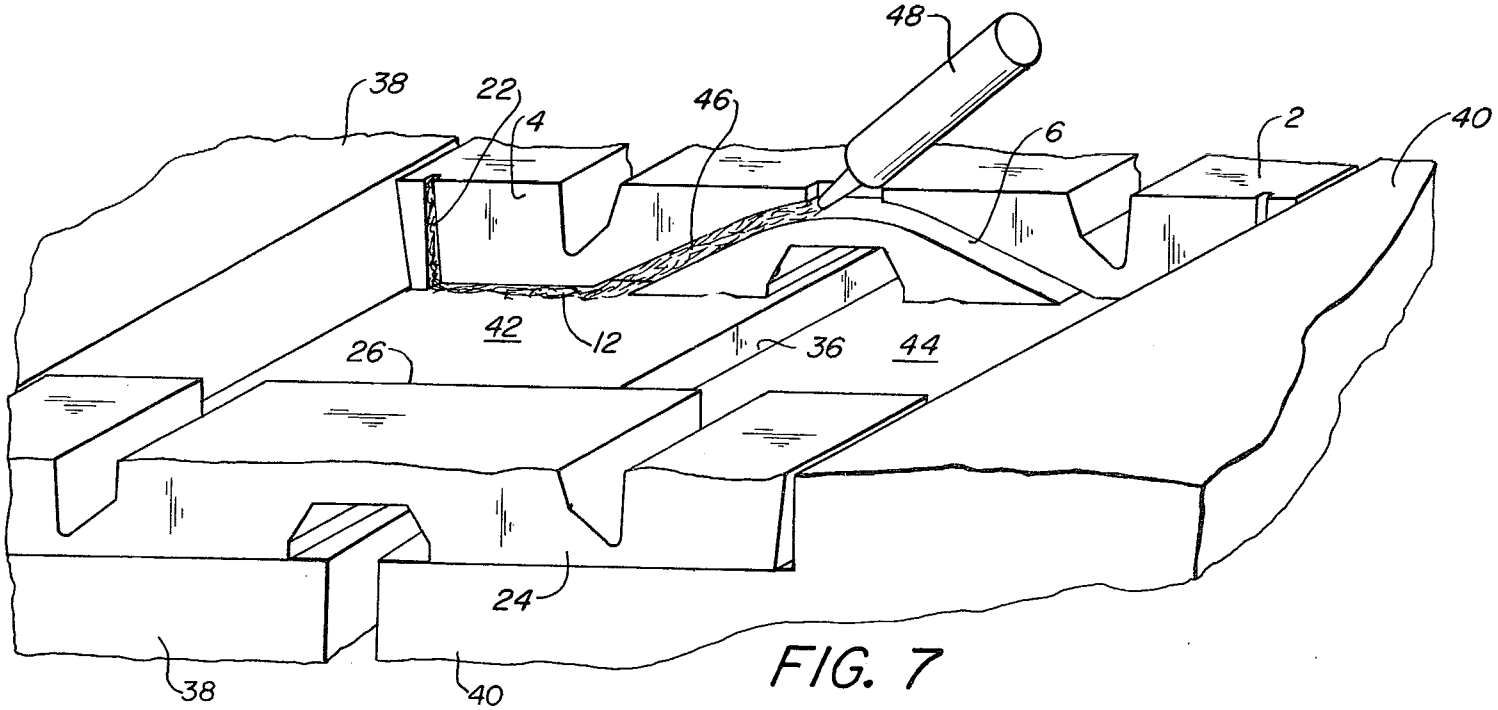
FIG. 7 is a perspective view of the elastomeric pad end portions of FIGS. 1 through 6, in place on sections of a structure and bridging an expansion gap therebetween, but prior to being jointed together.

FIG. 7 shows the elastomeric pads 2 and 24 placed over an expansion gap 36 between two structure sections 38 and 40, having respectively recessed platforms 42 and 44. The pads 2 and 24 are supported on the recessed platforms 42 and 44. While the end surfaces 4 and 26 of the pads would in actual practice be flush against each other, they are shown spaced apart only for the purpose of better showing the injection of sealant into one of the grooves 6 in the end surface 4.

When installing the elastomeric pads 2 and 24, they are first bolted to the platforms 42 and 44 with their end surfaces 4 and 26 engaging one another and the tongue 28 housed within groove 6 as shown in FIG. 6. The pads 2 and 24 do not need to be pressed against each other so tightly that the top edges of the end surfaces 4 and 26 pucker upwardly, as is sometimes necessary to form a good seal between other end surface constructions. After the pads 2 and 24 are thus bolted down, a suitable sealant 46, such as a silicone or urethane cement, is injected from containter 48 into the inlet port 8 of the grooves 6. As shown in FIG. 7, the sealant 46 flows through the intermediate sealing portion 12 of the groove 6 and up the vent portion 22. When the workman injecting the sealant sees the sealant 46 emerge from the top of the vent portion 22, he places his finger over the top of the vent portion 22 and continues to inject sealant to insure a good filling of the intermediate sealing portion 12. Then, the workman withdraws the nozzle of the sealant container while continuing to inject sealant into the portion of the groove 6 that was previously occupied by the nozzle of the container. He then repeats the same procedure to fill the groove 6 in the opposite side of the end surface 4. After both intermediate sealing portions of grooves 6 have been filled with sealant, their common inlet port 8 should be filled with sealant also, but not quite to the top surfaces of the elastomeric pads 2 and 24.

Figure 8:
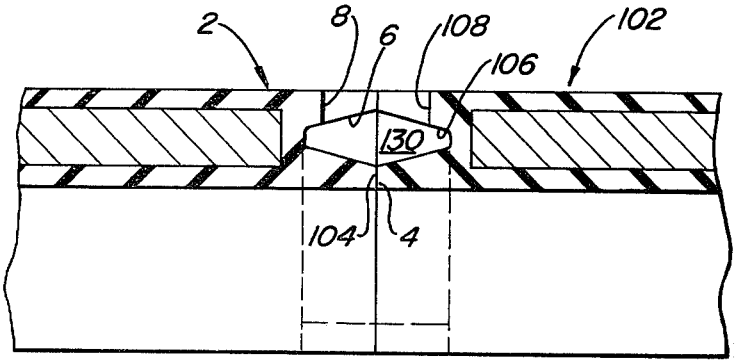
FIG. 8 is a sectional view similar to FIG. 6 of elastomeric pad end portions illustrating a modified version of the present invention.

While a pad 24 equipped with a tongue 28 represents a preferred form of the present invention, the pad that mates with the grooved end surface 4 of FIGS. 1 and 2 can be made without such a tongue. For instance, this pad may either have a flat end surface free of any grooves or tongues, or it may have a groove that matches the groove 6 of pad 2. In the latter case, both adjacent pad end surfaces would be constructed alike, and would appear together in section as shown in FIG. 8. As in FIG. 6, the pad 2 has an end surface 4 with a groove 6 having an inlet port 8. Likewise, the pad 102 has an end surface 104 abutting the end surface 4 of pad 2, and a groove 106 with an inlet port 108 facing the groove 6 and inlet port 8. The facing grooves 6 and 106 form a wide channel 130 for housing a suitable sealant. The sealant thus bridges the interface between the end surfaces 4 and 104 and prevents debris and liquid from seeping between these surfaces.

Figure 9:
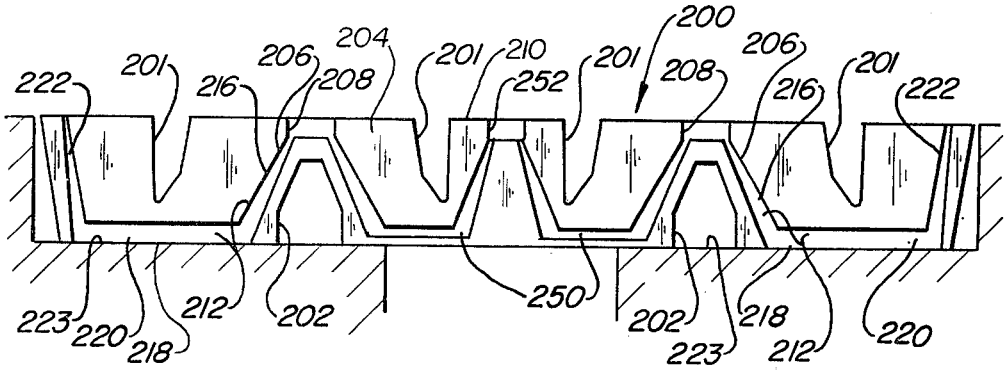
FIG. 9 is an end view of an elongated elastomeric pad of a slightly different type than the one of FIGS. 1 through 8, and illustrating another modification of the present invention.

FIG. 9 illustrates another embodiment of the present invention. The pad 200 is of a type used on structures where a relatively large amount of expansion is anticipated. For this reason, there are four expansion grooves 201 in the top surface of the pad and two expansion grooves 202 in the bottom surface of the pad. The end surface 204 of the pad 200 has at either side two grooves 206 similar to the grooves 6 of pad 2 of FIGS. 1 and 2. Like the grooves 6, the grooves 206 have inlet ports 208, intermediate portions 212 with parts 216 extending downwardly from the ports 208 and parts 220 extending along the bottom edge 218 of the end surface 204, and vent portions 222. The parts 220 extending along bottom edge 218 allow the sealant to bond to structure surfaces 223.

In addition to the grooves 206, other grooves 250 extend between the inlet ports 208 and loop downwardly beneath the top edge 210 of the end surface 204, but not quite down to the bottom edge 218. With a wide seal such as the pad 200, the grooves 250 preferably meet at a third inlet port 252 at the middle of top edge 218. In this manner, the grooves 250 seal the area of the end surface 204 between the inlet ports 208, and the parts 220 of grooves 206 close off this sealed area from debris and liquid that might seep in around the side edges of the pad 200.

The end surface 204 is designed to be placed against an end surface of another pad of a construction like that of pad 200. The end surface of this other pad may be of a grooved design like that of end surface 204, forming a sealing structure like that shown in FIG. 8; or there may be a tongue in the end surface of the other pad, similar to the tongue 28 of pad 24 in FIGS. 3 and 4, thus forming a sealing structure similar to that of FIG. 6. In this case the tongue would preferably extend opposite the entire lengths of grooves 250 and the parts 216 of grooves 206.

While several embodiments of the present invention have been shown and described, other embodiments and modifications will of course be apparent to those skilled in the art, while remaining within the scope of the appended claims.

I claim:

1. An expansion joint sealing assembly for sealing the gap between adjacent sections of a structure, said assembly including at least two elongated elastomeric pads placed end to end along the length of said gap, the facing end surfaces of said pads having portions thereof spaced from one another to form a channel between said end surfaces for housing a flowable sealant material, said sealing assembly characterized by said facing end surfaces having portions thereof in flush engagement with one another and the said channel for housing said sealant material being formed at least in part by a first of said end surfaces having a groove therein with an inlet port at the top edge of said first end surface, an intermediate sealing portion extending from said inlet port toward the bottom edge of said end surface, and a vent portion that communicates with said intermediate sealing portion and also with the top edge of said first end surface at a location spaced laterally from said inlet port.

2. An expansion joint sealing assembly as set forth in claim 1 wherein said sealing assembly is characterized by the second of said facing end surfaces having a tongue projecting therefrom that is aligned with at least a part of said intermediate sealing portion of said groove in said first end surface, said tongue being of thickness less than the width of said groove but projecting from said second end surface a distance greater than the depth of said groove in said first end surface, so that when said elastomeric pads are placed end to end with respect to each other, said groove both houses said tongue and provides a channel for said sealant and the outward tip of said tongue is compressed against the base of said groove.

3. An expansion joint sealing assembly as set forth in claim 1 wherein said sealing assembly is characterized by the said channel for housing said sealant material being formed by both of said end surfaces having grooves therein that are aligned with and facing each other.

4. An expansion joint sealing assembly as set forth in claim 1, 2, or 3 further characterized by said first end surface having the intermediate sealing portion of said groove communicating over a part of its length with the bottom edge of said end surface at a location where said bottom edge is designed to rest on one of said structure sections.

5. An expansion joint sealing assembly as set forth in claim 1, 2, or 3 further characterized by said first end surface having two of said grooves, said inlet portions of said grooves being located between the side edges of said end surface, and said vent portions of said grooves being located laterally outwardly from said inlet portions and near said side edges of said first end surface.

6. An expansion joint sealing assembly as set forth in claim 1, 2, or 3, further characterized by said first end surface having two of said grooves joined at a common inlet port at the top edge of said end surface, said inlet port being located between the side edges of said first end surface, said intermediate sealing portions of said grooves extending away from said common inlet port in opposite directions toward the opposite side edges of said first end surface, parts of said intermediate sealing portions extending downwardly to the bottom edge of said first end surface at locations where said bottom edge is designed to rest on said structure sections, and other parts of said intermediate sealing portions extending from said downward curving parts along the bottom edge of said frist end surface at locations where said bottom edge is designed to rest on said structure sections, and said vent portions of said grooves extending from said other parts of said intermediate portions up to said top edge of said end surface at locations near the opposite side edges of said first end surface.

7. An expansion joint sealing assembly as set forth in claims 1, 2, or 3 further characterized by said first end surface having two of said grooves, said inlet portions of said grooves being spaced apart and located between the side edges of said end surface, said first end surface also having a third groove extending between said inlet portions of said first two grooves and looping downwardly beneath said top edge of said first end surface, said intermediate sealing portions of said first two grooves extending away from their respective inlet ports in opposite directions toward the opposite side edges of said first end surface, parts of said intermediate sealing portions extending downwardly to the bottom edge of said first end surface at locations where said bottom edge is designed to rest on said structure sections, and other parts of said intermediate sealing portions extending from said downward curving parts along the bottom edge of said first end surface at locations where said bottom edge is designed to rest on said structure sections, and said vent portions of said grooves extending from said other parts of said intermediate portions up to said top edge of said end surface at locations near the opposite side edges of said first end surface.

8. A method of installing an elastomeric sealing assembly including the steps of laying two elastomeric sealing pads end to end along the length of an expansion gap between two structure sections, securing said sealing pads in place on said structure sections with the end surfaces of said pads abutting each other, characterized in that after said sealing pads are so secured in place, there are the additional steps performed of inserting the nozzle of a sealant container into an inlet port in the top edge of at least one of the abutting end portions of said pad end surfaces, discharging a sealant from said container into a groove in said end surface that communicates with said inlet port until said sealant emerges from a vent portion of said groove that has an opening in said top edge of said end surface that is spaced from said inlet port, then covering said vent portion opening while continuing to discharge sealant into said groove, and then withdrawing said nozzle of said sealant container from said inlet port.

* * * * *